US006148465A

United States Patent [19]

Hsieh et al.

[11] Patent Number: 6,148,465

[45] Date of Patent: Nov. 21, 2000

[54] MOPHEAD FOR A SPONGE MOP

[76] Inventors: Ming-Ti Hsieh, 4/F., No. 10, Alley 13, Lane 26, Chung-Shun St., Sec. 1, Taipei City; Mo-Hsaing Lin, No. 148-1, Ta-Ying Rd., Chunan Town, Miaoli County, both of Taiwan

[21] Appl. No.: 09/304,058

[22] Filed: May 4, 1999

[51] Int. Cl.[7] ..... A47L 13/257; A47L 13/258

[52] U.S. Cl. ..... 15/118; 15/119.2

[58] Field of Search ..... 15/116.1, 116.2, 15/118, 119.1, 119.2, 121, 244.1, 244.3

[56] References Cited

U.S. PATENT DOCUMENTS

| | | | |
|---|---|---|---|
| 970,563 | 9/1910 | Schwalen | 15/121 |
| 2,051,058 | 8/1936 | Replogle | 15/121 |
| 2,891,270 | 6/1959 | Reiter | 15/119.2 |
| 3,406,420 | 10/1968 | Siemund | 15/121 |
| 3,783,469 | 1/1974 | Siemund | 15/121 |
| 3,789,451 | 2/1974 | Laitner | 15/121 |
| 5,429,678 | 7/1995 | Fany | 15/121 |

*Primary Examiner*—Terrence R. Till
*Attorney, Agent, or Firm*—Rosenberg, Klein & Lee

[57] ABSTRACT

A mophead for a sponge mop, which includes a sponge body, and two protective cover layers covered on two opposite side walls of the sponge body, wherein the protective cover layers, which can be made of foamed skin, scouring pad, or woven fabrics, each have open spaces of size smaller than open spaces in the sponge body, a density greater than the sponge body, and a bottom scraper portion, which scrapes dirt from the floor when the mophead is moved over the floor.

5 Claims, 4 Drawing Sheets

MOPHEAD FOR A SPONGE MOP

BACKGROUND OF THE INVENTION

The present invention relates to a mophead for a sponge mop, and more particularly to such a mophead which comprises a sponge body, and two protective, water penetrable cover layers covered on two opposite side walls of the sponge body.

A regular sponge mop, as shown in FIGS. 9 and 10, is generally comprised of a handle 7, a presser plate 713, a lever 71, a link 711 connected between the lever 71 and the presser plate 713, a mophead holder 712 fastened to the bottom end of the handle 7, and a mophead 8 installed in the mophead holder 712. The lever 71 can be operated to move the link 711 up and down, causing the mophead 8 to be compressed by or released from the presser plate 713. The mophead 8 is a piece of sponge having open spaces 81 in it. Because the mophead 8 is a piece of sponge directly installed in the mophead holder 712, frequently operating the presser plate 713 to squeeze the mophead 8 may cause the mophead 8 to be damaged or permanently deformed. Furthermore, because the mophead 8 is soft and flexible, it does not produce a suitable friction force to remove dirt from the floor when moved over the floor. Therefore, this structure of sponge mop cannot effectively clean the floor.

SUMMARY OF THE INVENTION

The present invention has been accomplished to provide a mophead for a sponge mop which eliminates the aforesaid drawbacks. According to one aspect of the present invention, the mophead has two protective cover layers at two opposite sides of its sponge body for protection. Therefore, frequently operating the pressure plate to compress the mophead does not cause the sponge body of the mophead to be damaged or permanently deformed. According to another aspect of the present invention, the protective cover layers each have a bottom scraper portion for scraping out dirt from the floor. According to still another aspect of the present invention, the protective cover layers can be made of foamed material, scouring pad, or woven fabrics.

DETAILED DESCRIPTION OF THE PREFERRED EMBODIMENT

Figure 1:
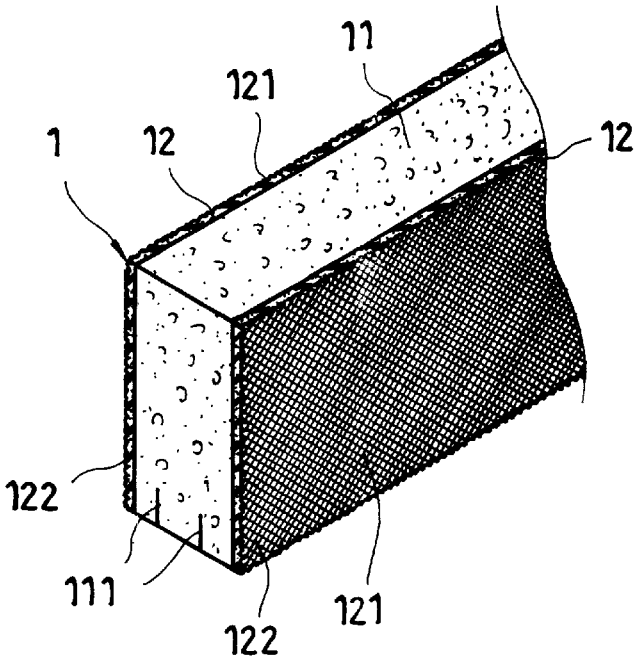
FIG. 1 is a perspective view of a part of a mophead according to a first embodiment of the present invention.

Referring to Figures from 3 through 5, a mophead 1 is fastened to the mophead holder 512 of a sponge mop 5. The sponge mop 5 comprises a presser plate 513, a lever 51, and a link 511 connected between the lever 51 and the presser plate 513. The lever 51 can be operated to move the link 511 up and down, causing the mophead 1 to be compressed by or released from the presser plate 513.

Figure 2:
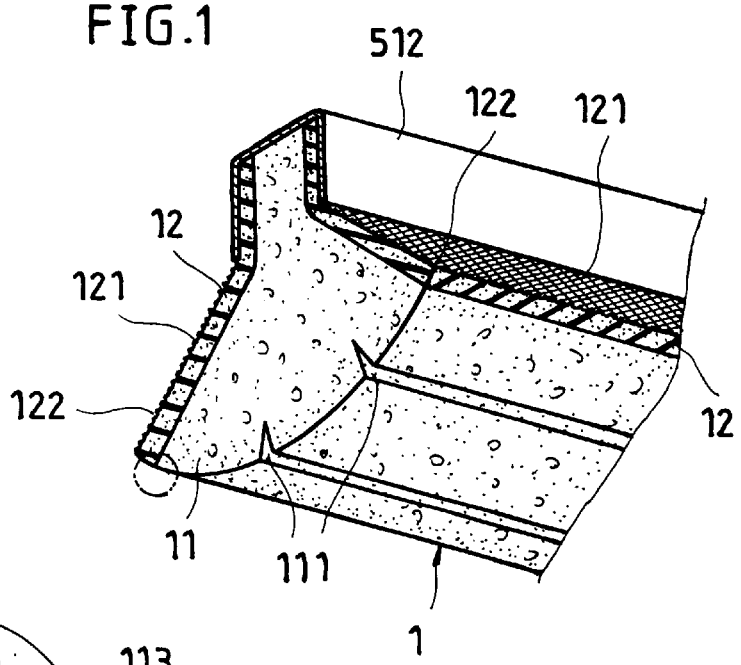
FIG. 2 shows the mophead of the first embodiment of the present invention installed in a mophead holder.
Figure 2A:
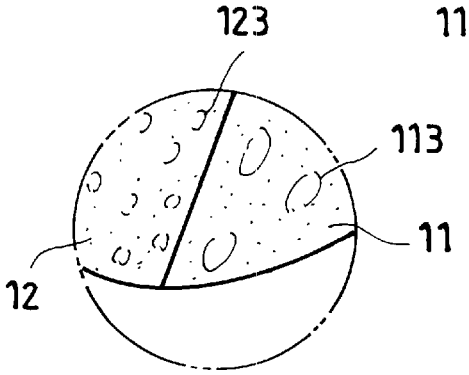
FIG. 2A is an enlarged view of a sponge body and a foam cover layer of the present invention.
Figure 3:
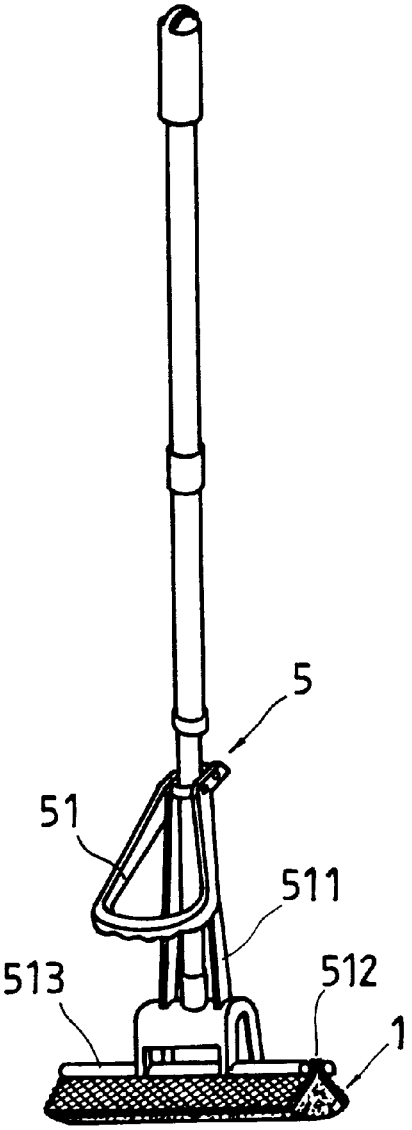
FIG. 3 is a perspective view showing a sponge mop equipped with a mophead constructed according to the present invention.
Figure 4:
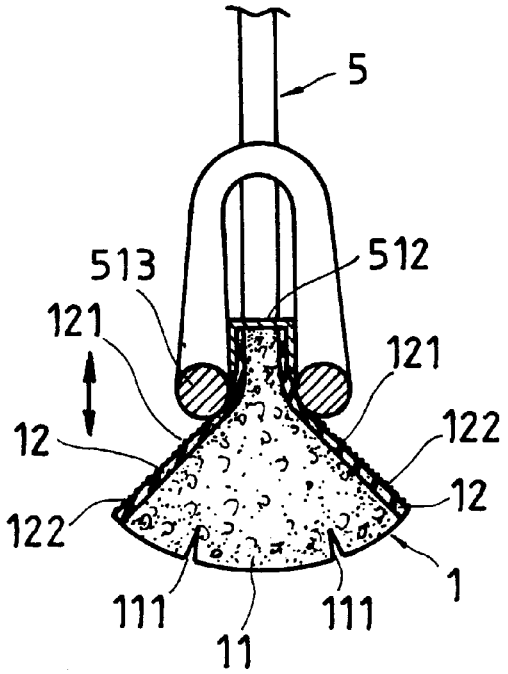
FIG. 4 is a side view in section in an enlarged scale of the lower part of the sponge mop shown in FIG. 3.
Figure 5:
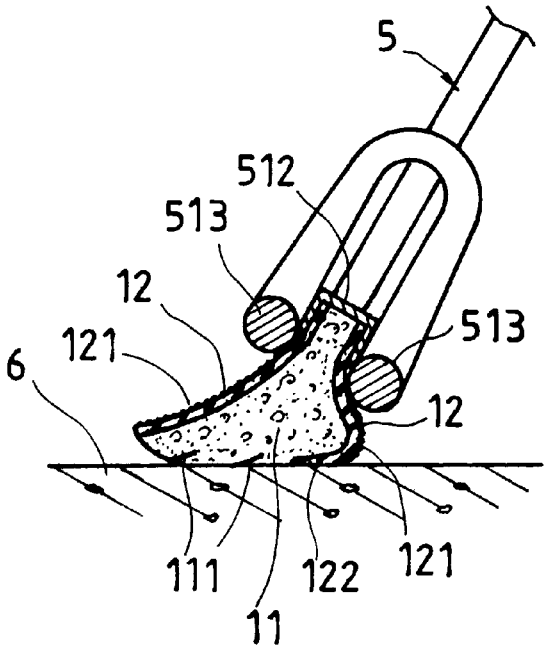
FIG. 5 illustrates the sponge mop moved over the floor according to the present invention.

Referring to FIGS. 1 and 2 and Figures from 3 through 5 again, the mophead 1 comprises a sponge body 11, and two foamed cover layers 12 covered on two opposite side walls of the sponge body 11. The foamed cover layers 12 have fine open spaces 123. The open spaces 123 in the foamed cover layers 12 is relatively smaller than the open spaces 113 in the sponge body 1. After installation in the mophead holder 512, the lower part of the mophead 11 forms a sector-like profile. Because sponge body 11 is protected by the foamed cover layers 12, operating the lever 51 to force the presser plate 513 against the mophead 1 does not damage the sponge body 11. The foamed cover layers 12 each have an embossed pattern 121 on the respective outside wall, and a bottom scraper portion 122 which scrapes out dirt from the floor 6 when the mophead 1 is moved over the floor 6. Further, the sponge body 11 has a plurality of longitudinal grooves 111 at its bottom side, which improves the dust collecting effect of the sponge body 11.

Figure 6:
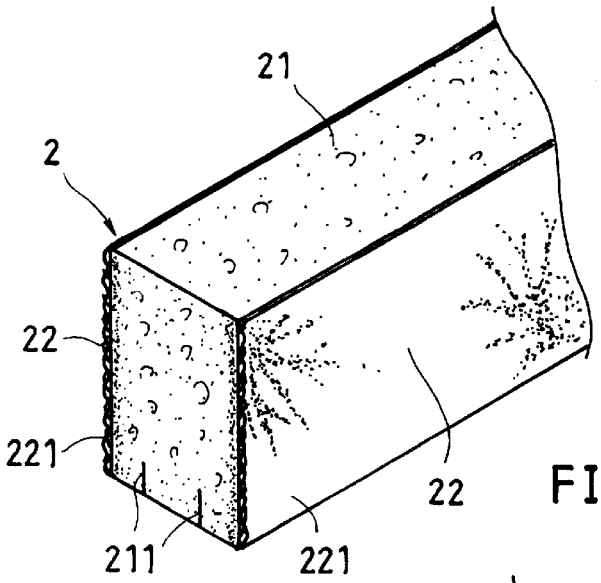
FIG. 6 is a perspective view of a part of a mophead according to a second embodiment of the present invention.

FIG. 6 illustrates a mophead according to a second embodiment of the present invention. According to this embodiment, the mophead 2 comprises a sponge body 21, and two woven fabric cover layers 22 covered on two opposite side walls of the sponge body 2. The sponge body 21 has two longitudinal grooves 211 at its bottom side. The woven fabric cover layers 22 each have a bottom scraper portion 221, which scrapes out dirt 22 each have a bottom scraper portion 221, which scrapes out dirt from the floor when the mophead 2 is moved over the floor.

Figure 7:
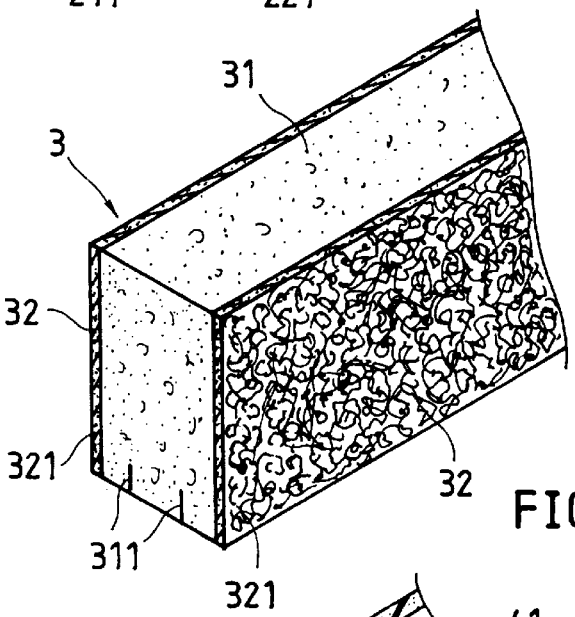
FIG. 7 is a perspective view of a part of a mophead according to a third embodiment of the present invention.

FIG. 7 illustrates a mophead according to a third embodiment of the present invention. According to this embodiment, the mophead 3 comprises a sponge body 31, and two scouring pads 32 covered on two opposite side walls of the sponge body 3. The sponge body 31 has two longitudinal grooves 311 at its bottom side. The scouring pads 32 each have a bottom scraper portion 321, which scrapes out dirt from the floor when the mophead 3 is moved over the floor.

Figure 8:
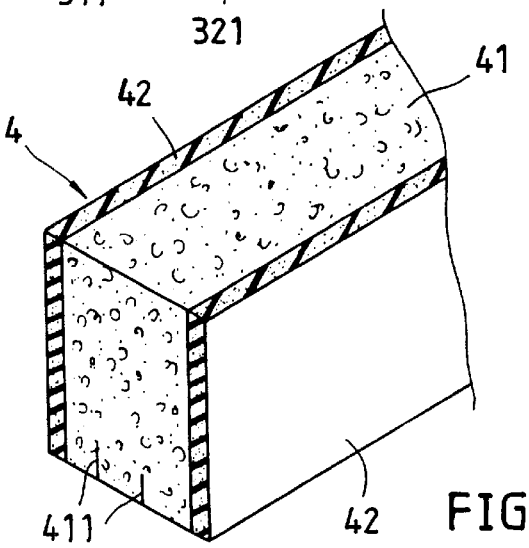
FIG. 8 is a perspective view of a part of a mophead according to a fourth embodiment of the present invention.
Figure 9:
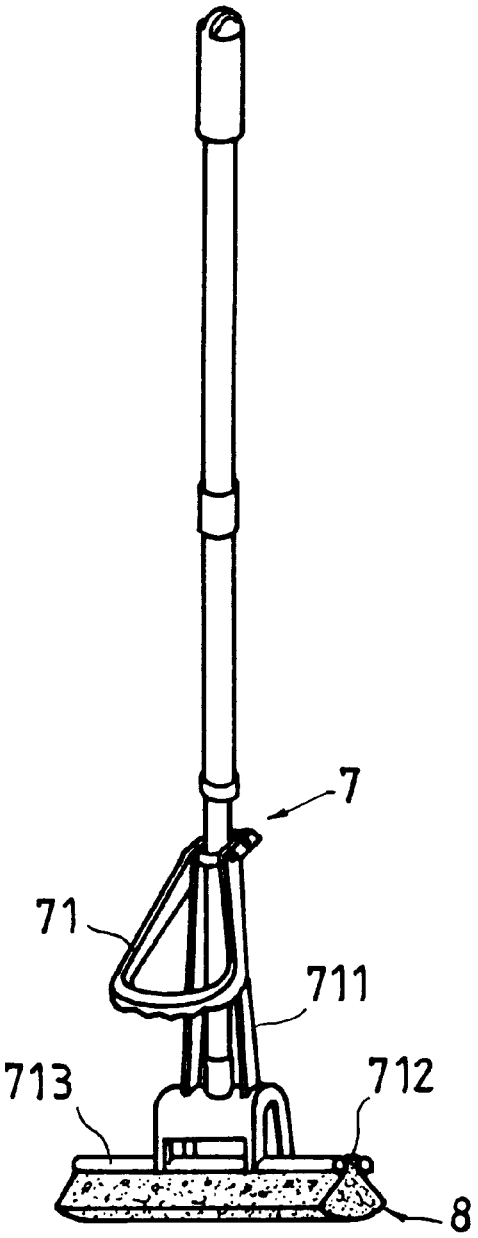
FIG.9 PRIOR ART
FIG. 9 is a perspective view of a sponge mop equipped with a prior art mophead.
Figure 10:
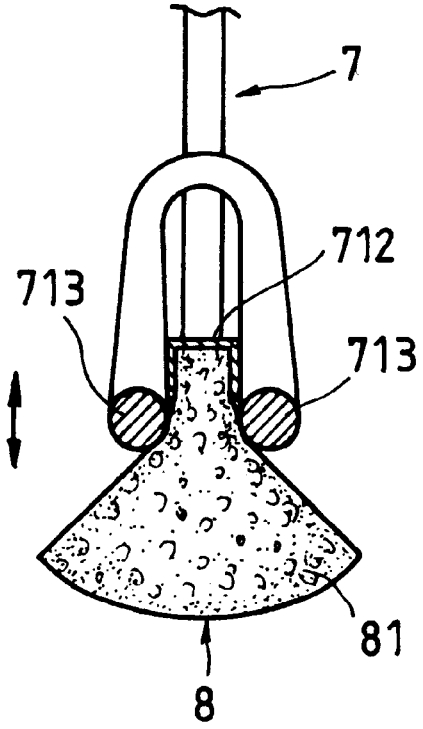
FIG.10 PRIOR ART
FIG. 10 is an applied view of the sponge mop shown in FIG. 9.

FIG. 8 illustrates a mophead according to a fourth embodiment of the present invention. According to this embodiment, the mophead 4 comprises a sponge body 41, and two cover skin layers 42 covered on two opposite side walls of the sponge body 4. The sponge body 41 has two longitudinal grooves 411 at its bottom side. The cover skin layers 42 each have a plain outside wall, and a bottom scraper portion 421, which scrapes out dirt from the floor when the mophead 4 is moved over the floor.

It is to be understood that the drawings are designed for purposes of illustration only, and are not intended for use as a definition of the limits and scope of the invention disclosed.

What the invention claimed is:

1. A mophead for a sponge mop comprising a sponge body, and two protective cover layers covered on two opposite side walls of said sponge body, wherein said protective cover layers each have open spaces of size smaller than open spaces in said sponge body, a density greater than said sponge body, and a bottom scraper portion, which scrapes dirt from the floor when the mophead is moved over the floor.

2. The mophead of claim 1 wherein said protective cover layers are made of foamed material having an embossed outside wall.

3. The mophead of claim 1 wherein said protective cover layers are made of foamed material having a plain outside wall.

4. The mophead of claim 1 wherein said protective cover layers are respectively made of woven fabrics.

5. The mophead of claim 1 wherein said protective cover layers are respectively comprised of a scouring pad.

* * * * *